United States Patent [19]

Alheid et al.

[11] 4,246,301

[45] Jan. 20, 1981

[54] WEB COATER

[75] Inventors: Robert J. Alheid, Beloit, Wis.; Irvin J. Phillips, South Beloit, Ill.

[73] Assignee: Beloit Corporation, Beloit, Wis.

[21] Appl. No.: 53,734

[22] Filed: Jul. 2, 1979

[51] Int. Cl.[3] ..... B05D 1/28; B05D 3/12; B05C 1/00

[52] U.S. Cl. ..... 427/348; 118/63; 118/249; 118/262; 427/361; 427/428

[58] Field of Search ..... 427/365, 369, 428, 348, 427/361; 118/262, 249, 63

[56] References Cited

U.S. PATENT DOCUMENTS

| | | | |
|---|---|---|---|
| 2,105,488 | 1/1938 | Massey et al. | 427/428 X |
| 2,176,093 | 10/1939 | Merrill | 427/365 X |
| 2,225,877 | 12/1940 | Melton et al. | 118/63 X |
| 2,252,204 | 8/1941 | Reilly | 427/365 X |
| 2,366,926 | 1/1945 | Milton | 427/428 X |
| 2,676,563 | 4/1954 | Montgomery et al. | 118/227 |
| 2,766,720 | 10/1956 | Muller et al. | 118/63 |
| 2,772,184 | 11/1956 | Wolfe et al. | 427/362 |
| 2,940,418 | 6/1960 | Pinrod et al. | 118/63 |
| 2,970,564 | 2/1961 | Warner | 118/249 |
| 3,044,440 | 7/1962 | Molsberry et al. | 118/249 |
| 3,202,536 | 8/1965 | Brezinski | 427/411 X |
| 3,293,067 | 12/1966 | Streb et al. | 427/209 X |
| 3,424,126 | 1/1969 | Mahoney | 118/63 |
| 3,647,525 | 3/1972 | Dahlgren | 427/428 |
| 3,731,652 | 5/1973 | Reba et al. | 118/63 |
| 4,029,833 | 6/1977 | Kosta | 427/428 |

*Primary Examiner*—Michael R. Lusignan

*Attorney, Agent, or Firm*—Hill, Van Santen, Steadman, Chiara & Simpson

[57] ABSTRACT

A traveling web coater for applying a smooth uniform layer of liquid coating of controlled weight onto the surface of a traveling web including a gate coater having a plurality of gate rolls for metering and applying coating to a traveling web supported on a backing roll with an air knife positioned to direct air onto the web downstream from the gate rolls and to essentially smooth the coating removing a minimum amount of the coating which has been accurately metered by the gate rolls.

10 Claims, 2 Drawing Figures

WEB COATER

BACKGROUND OF THE INVENTION

Figure 1:
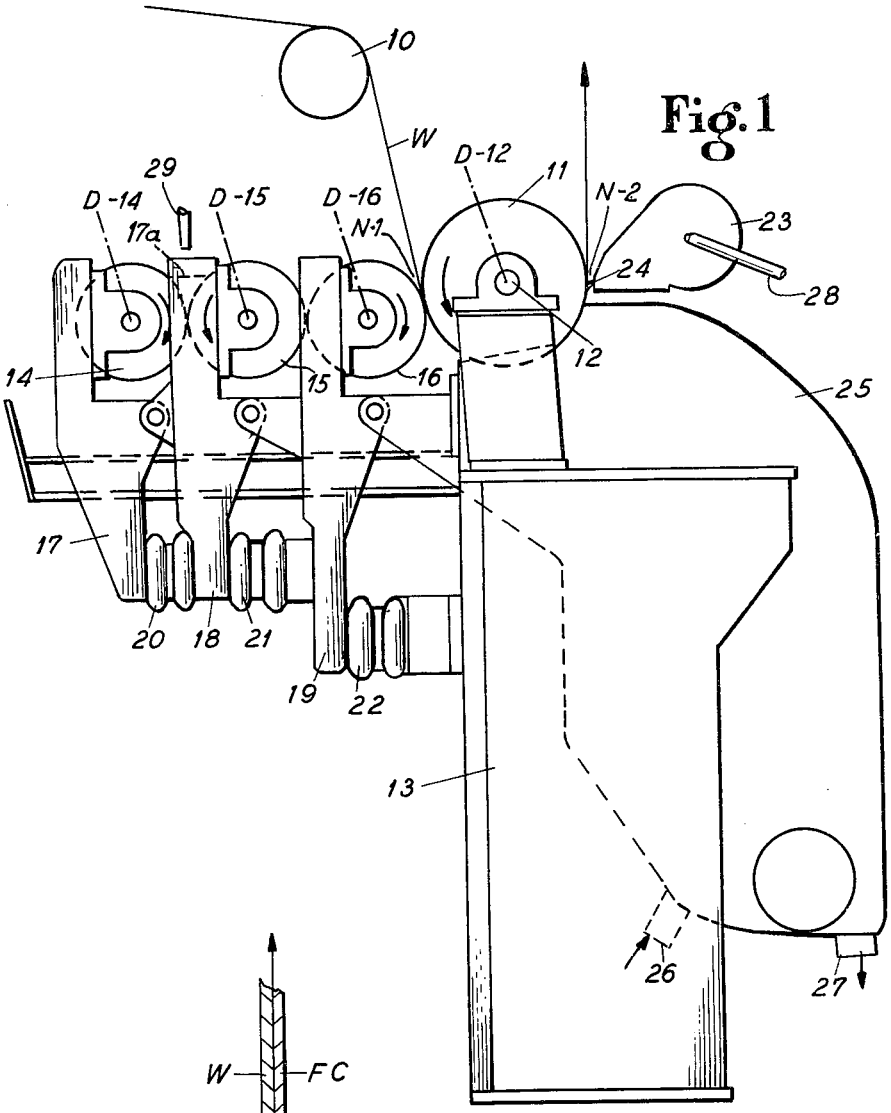

The invention relates to improvements in methods and mechanisms for coating traveling webs such as web of paper and the like for on-machine or off-machine coating, and particularly relates to an improved mechanism wherein the coating is carefully metered and carefully smoothed without necessitating removal of a substantial amount of the coating after it has been applied to the web.

Various methods and apparatuses have been used in the art for applying coating to traveling webs such as paper, and a discussion of the background of coater developments may be found in the book "Pulp and Paper Manufacture", 2nd Edition Volume 1, pages 498 through 517 entitled "Control Secondary Fiber Structural Board Coating". Two primary types of coaters which have gained commercial acceptance are flooded-nip coaters wherein an excess of coating is applied to a traveling sheet and the excess is wiped off and smoothed by a trailing flexible blade, and such coaters can be used to apply pigmented and nonpigmented solutions in a range of coating weights from 3 to 20 pounds per 3000 square feet with a range of solids 0% to 65% at speeds of up to 4000 feet per minute and beyond.

Another type of coater which has gained commercial acceptance is an air knife coater wherein an excess of coating is applied to a surface and a jet of air directed at the oncoming coating removes a substantial amount of the coating thereby smoothing the surface underneath. Such a coater can handle a range of coat weights on the order of 0 pounds to 18 pounds per side per 3000 square feet with a range of solids of 0% to 55% at speeds of 1200 feet per minute. In practice an air knife coating apparatus includes a means to apply a non-divergent jet of air onto the oncoming web with the air emitted from a straight slit orifice of a nozzle. The jet of air trims off the uniformly thick layer of coating which has been applied to the web leaving a desired quantity of coating on the web in a layer of uniform thickness. The finished quality of any coater paper prepared with an air knife coater is dependant to a considerable extent on the quality of the paper sheet or web inasmuch as the air jet will remove coating leaving a coated layer which follows the highs and lows of the base sheet. Another problem encountered with conventional air jet coaters is that the energy level required is substantial requiring the provision of a substantial amount of air and limitation as to the speed of travel of the web. The air jet must have sufficient force to shear the overcoat away from the coating. The air jet must have sufficient mass momentum to overcome the mass momentum of the overcoat, to bring its velocity to zero and reaccelerate it in the reverse direction. Calculations show that the speed limit due to momentum exchange is proportional to the square root of the inverse of the overcoat weight. Conventionally, an air knife coater will trim an overcoat weight of coating from the web equal to the finish coat which remains on the sheet, and although this proportion may be varied, substantial limitations are imposed by the requirement that the air jet trim the substantial amount of overcoat weight in order to leave the proper thickness of coating on the web and to leave a smooth finished surface.

It is an object of the present invention to provide an improved mechanism and method for coating which attains the quality of coating normally provided by an air knife coater and yet which does not have the limitations as to speed of travel and the disadvantages of having to handle the amount of overcoat removed that are present in conventional machines.

In the best conventional presently used air knife coater, if 6 pounds of coating is applied onto the sheet, the air knife in its smoothing levelling process will remove 3 pounds and 3 pounds remains. At times when it is necessary to increase the speed of the coater, not enough coating can be removed by using the air knife.

In accordance with the principles of the present invention, the amount of coating applied to the web is initially carefully metered by a gate roll applicator, and the principal function of the air knife is to smooth the carefully metered and accurately applied layer of coating, rather than remove the coating. A small amount of coating is removed by the air knife normally in the range of 0% to 50%, but with the careful metering and levelling of the coating in the initial gate roll application, the air knife presents a superior finished smooth product without the limitations as to speed of travel and without the necessary application of energy required to remove the coating. Also, the necessity of handling an excessive amount of removed overcoat is avoided. Heretofore high speed coating has been reserved for blade coaters, but in some circumstances, a blade coater is not desirable. For example, unbleached kraft raw stock when coated with white coating formula and smoothed with a blade exhibits show-through in high spots. The darker colored raw stock shows through the white coating. With the application of the principles of the present invention, utilizing an air knife levelling means, it will be possible to apply just slightly more coating or essentially the same coating that is required and produce a smooth coating surface with no show-through by levelling with the air knife.

Other objects, advantages and features, as well as equivalent methods and structures which are intended to be covered herein, will become more apparent with the teaching of the principles of the present invention in connection with the disclosure of the preferred embodiments in the specification, claims, and drawings, in which:

DRAWINGS

Figure 2:
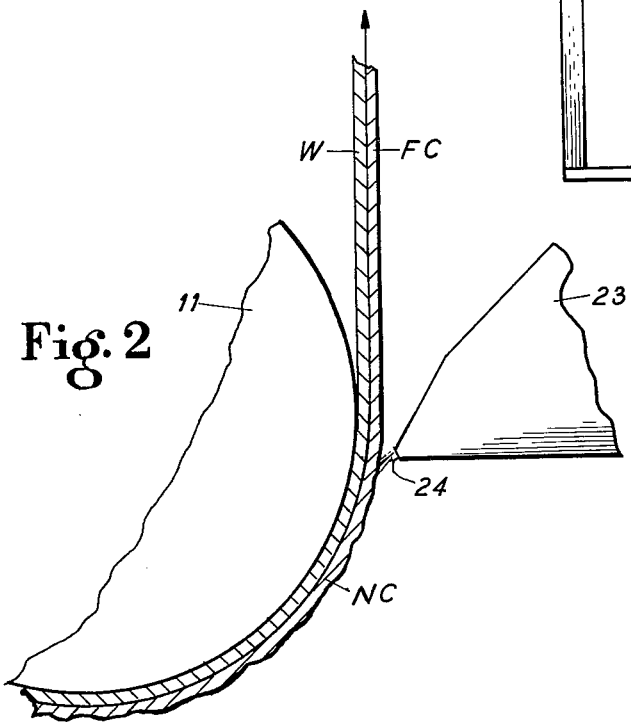

FIG. 1 is a somewhat schematic side elevational view illustrating a coater constructed and operating in accordance with the principles of the present invention; and FIG. 2 is a fragmentary sectional view, somewhat enlarged as contrasted with FIG. 1, of a web supported on a backing roll illustrating the air knife smoothing the coating surface.

DESCRIPTION

The coater shown in the drawings receives a traveling web which is either fed off of a supply roll in an off-machine coater or comes directly from the paper making machine in an on-machine coater. The web travels over a guide roll 10 and is threaded over a backing roll 11. The backing roll forms a nip with a transfer roll 16 with the nip being shown at N-1 where a metered layer of coating is applied to the surface of the web. The web travels along at sheet speed over the backup roll 11 into the second nip N-2 formed with an air knife 23.

The backing roll is supported on end bearings 12 which are mounted on a stand 13 which rests on the mill room floor.

The metered coating is applied by a series of gate rolls 14, 15 and 16 with 16 being designated as the transfer roll. The gate rolls are supported in end bearings carried on rocker arms 17, 18 and 19 respectively for the rolls 14, 15 and 16. The pivotal rocker arms are mounted so that forces applied at the lower ends will determine the pressure in the nips between the rolls to control the amount of coating transferred onto the traveling paper web. For applying this pressure to the rocker arms, inflatable air bellows 20, 21 and 22 are positioned at the lower ends of the arms. These rocker arms may be run with stops between the bearing housing for controlled gap application. The rolls are each driven by drive means shown respectively at D-14, D-15 and D-16 for the gate rolls 14, 15 and 16. The backing roll 12 is also driven by a drive shown at D-12 with it being driven at sheet speed. In certain circumstances, the backing roll need not be driven and will be rotated by frictional engagement with the traveling web W. The drives for the gate rolls are speed controlled drives and are operated so that the transfer roll 16 is driven at from 50% to 100% of the sheet speed. The metering roll 15 which forms the close running nip with the transfer roll is driven at a speed ranging from 30% to 75% of sheet speed. The end metering roll 14 is driven at a speed in the range of 5% to 50% of sheet speed. By control of the nip forces between these rolls and control of their speeds, the amount of coating applied to the sheet can be carefully and controllably metered and regulated and, of course, the amount transferred will be a function of the viscosity and type of coating used and the amount applied will depend upon the type of sheet to be coated, the coating required and, of course, the speed of travel of the web.

After the coating has been applied in a carefully metered amount, it is carried along with the web up to the nip N-2 of the air knife 23. The air knife has an air jet 24 where a jet of air is blown onto the oncoming web under pressure, and air is supplied by a suitable supply line indicated schematically at 28. The basic function of the air knife is to smooth the layer of web as is indicated schematically in FIG. 2. Essentially the correct amount of coating is placed on the web indicated by the layer NC, and as it passes the air knife, it is smoothed so that it has a finished smooth outer surface as indicated at FC in FIG. 2. A limited amount of coating will be removed incidental to the smoothing operation, but this will be limited to the range of 0% to 50% of final coating.

To capture the coating which is removed incidentally, a catch pan 25 is positioned below the air knife to catch the coating which sprays or drips downwardly and generally the air knife will induce a jet of coating flowing downwardly. The pan 25 which contains the coating has a drain 27 to remove the coating, and a shower arrangement is shown at 26 for flushing and cleaning the container.

In operation coating is carefully metered by gate rolls 14, 15 and 16 with the coating being delivered to the upwardly facing nip to form a puddle 17*a* by a supply line 29. The metered coating is applied by a transfer roll 16 to the oncoming web in the nip N-1 in a uniform metered layer. This layer is smoothed by the air jet 24 with air emitting from the nozzle 25 and the accurately metered layer of coating then will have a finished smooth surface. The air jet will level and smooth the coating without endangering show-through of the web underneath and will provide a surface which has a superior appearance and superior ink receptivity.

We claim as our invention:

1. A traveling web coater for applying a smooth uniform layer of liquid coating of controlled weight onto the surface of a fast moving traveling web comprising in combination:

a plurality of parallel coating gate rolls including metering rolls in close running relationship for accurately metering and transferring coating onto the surface of a traveling web including a transfer roll in close running relationship with the web;

a backing roll over which a web is threaded with a transfer nip formed with the transfer roll for applying the layer of coating of controlled thickness onto the web supported on the backing roll;

nip control means controlling the nip pressure between said metering rolls and between the metering rolls and transfer roll;

means for delivering coating to the upwardly facing nip between adjacent metering rolls with the coating being transferred by the metering rolls and the transfer roll to the web;

and an air knife positioned downstream of said transfer nip smoothing the transferred coating on the web with the primary function of the knife being to smooth the surface of the layer of coating.

2. A traveling web coater for applying a smooth uniform layer of liquid coating of controlled weight onto the surface of a fast moving traveling web constructed in accordance with claim 1:

wherein there are three gate rolls for transferring the coating onto the paper web and the air knife directs a flow of air onto the web surface while it is supported by the backing roll and removes coating from the surface in a limited amount ranging only from 0% to 50% of the coating on the web.

3. A traveling web coater for applying a smooth uniform layer of liquid coating of controlled weight onto the surface of a fast moving traveling web constructed in accordance with claim 2:

wherein each of the gate rolls is supported at its ends on a bearing carried on the upper ends of rocker arms and the structure includes a pressure controllable air bellows at the lower end of the rocker arms for controlling the nip pressure between the rolls.

4. A traveling web coater for applying a smooth uniform layer of liquid coating of controlled weight onto the surface of a fast moving traveling web constructed in accordance with claim 2:

including means for driving each of the gate rolls with the transfer roll being driven at a range of speed from 50% to 100% of the sheet speed.

5. A traveling web coater for applying a smooth uniform layer of liquid coating of controlled weight onto the surface of a fast moving traveling web constructed in accordance with claim 4:

including the metering roll forming the nip with the transfer roll being driven at a speed in the range of 30% to 75% of the speed of the web and the metering roll which forms a nip with the first metering roll being driven at a speed of 5% to 50% of the web speed.

6. A traveling web coater for applying a smooth uniform layer of liquid coating of controlled weight onto the surface of a fast moving traveling web constructed in accordance with claim 1:

wherein the nip between the transfer roll and backing roll is on the downrunning side of the backing roll and the air knife is located on the uprunning side of the backing roll and a collection housing is located beneath the air knife for collecting coating directed downwardly due to the flow of air from the air knife.

7. The method of coating a fast moving traveling web which comprises the steps:

metering liquid coating onto the surface of the traveling web in a controlled metered layer with a series of close running gate rolls including a transfer roll for transferring the coating to the web surface with the gate rolls being pressure and speed controlled for controlling the amount of coating fed onto the web;

and smoothing the coating which has been applied by the gate rolls with an air knife with the air knife performing principally a smoothing function and removing only an incidental portion of the coating from the surface.

8. The method of coating a fast moving traveling web in accordance with the steps of claim 7:

wherein the air knife removes an amount of coating in the range of 0% to 50% of the total coating layer.

9. The method of coating a fast moving traveling web in accordance with claim 7:

including controlling the drive speed of the gate rolls with the transfer roll adjacent the web being driven 50% to 100% of sheet speed, the next adjacent gate roll being driven at 30% to 75% of sheet speed and the next roll being driven at 5% to 50% of sheet speed.

10. A fast moving traveling web coater for applying a smooth uniform layer of liquid coating of controlled weight onto the surface of a traveling web constructed in accordance with claim 3:

and including stops for the bearings controlling the spacing between the bearings and the spacing between the rolls for regulating the transferral of liquid coating.

* * * * *